US011808005B2

(12) United States Patent
Porter

(10) Patent No.: US 11,808,005 B2
(45) Date of Patent: Nov. 7, 2023

(54) EXTRUDED FRICTIONALLY-ENHANCED REINFORCED PILE

(71) Applicant: Mark A. Porter, Jacksonville, FL (US)

(72) Inventor: Mark A. Porter, Jacksonville, FL (US)

( * ) Notice: Subject to any disclaimer, the term of this patent is extended or adjusted under 35 U.S.C. 154(b) by 43 days.

(21) Appl. No.: 17/456,158

(22) Filed: Nov. 22, 2021

(65) Prior Publication Data

US 2022/0081860 A1 Mar. 17, 2022

Related U.S. Application Data

(63) Continuation-in-part of application No. 16/722,892, filed on Dec. 20, 2019, now Pat. No. 11,186,961.

(51) Int. Cl.

| | |
|---|---|
| ***E02D 5/22*** | (2006.01) |
| ***E02D 5/24*** | (2006.01) |
| ***E02D 5/80*** | (2006.01) |
| ***E02D 5/28*** | (2006.01) |
| ***E02D 27/52*** | (2006.01) |

(52) U.S. Cl.

CPC ..... *E02D 5/285* (2013.01); *E02D 5/226* (2013.01); *E02D 27/525* (2013.01); *E02D 2200/1685* (2013.01); *E02D 2250/0015* (2013.01); *E02D 2300/0007* (2013.01); *E02D 2300/0045* (2013.01); *E02D 2300/0053* (2013.01)

(58) Field of Classification Search

CPC ..... E02D 5/24; E02D 5/226; E02D 27/525; E02D 2250/0015; E02D 2300/0007; E02D 2300/0045; E02D 2300/0053; E04C 3/36

See application file for complete search history.

(56) References Cited

U.S. PATENT DOCUMENTS

| | | | |
|---|---|---|---|
| 3,941,157 | A | 3/1976 | Barnett |
| 3,957,250 | A | 5/1976 | Murphy |
| 4,110,989 | A | 9/1978 | Selkirk |
| 4,183,777 | A | 1/1980 | Summers et al. |
| 4,697,649 | A | 10/1987 | Kinnan |
| 5,051,285 | A | 9/1991 | Borzakian |
| 5,706,620 | A | 1/1998 | De Zen |

(Continued)

FOREIGN PATENT DOCUMENTS

| | | | |
|---|---|---|---|
| CN | 203783246 | | 8/2014 |
| CN | 109796699 | A * | 5/2019 |

(Continued)

OTHER PUBLICATIONS

E-Glass Chopped Strand Fibers, Lauscha Fiber International, Jun. 2014, https://www.unifrax. com/wp-contenUuploads/2018/08/U- 807-EN.pdf (Year: 2014).

*Primary Examiner* — Benjamin F Fiorello
*Assistant Examiner* — Stacy N Lawson
(74) *Attorney, Agent, or Firm* — Mark Young, PA

(57) ABSTRACT

A pile is comprised of a pipe, i.e., a hollow tube or hollow cylinder, with a coextensive internal reinforcement comprised of a plurality of intersecting walls. The pile is comprised of a blend of a thermoplastic and 20 to 50% (pbw) pelletized chopped strand glass fibers. The outer surface includes a co-extruded cap stock that is relatively smooth and exhibits a relatively low coefficient of friction. The internal structures exhibit roughness, bumpiness and a relatively high coefficient of friction for an extruded plastic. A groove may be formed in the pile adjacent to an end for resistance to uplift.

20 Claims, 15 Drawing Sheets

(56) References Cited

U.S. PATENT DOCUMENTS

| | | | |
|---|---|---|---|
| 6,123,485 | A | 9/2000 | Mirmiran et al. |
| 6,405,974 | B1 | 6/2002 | Herrington |
| 6,675,919 | B2 | 1/2004 | Mosing et al. |
| 6,955,780 | B2 | 10/2005 | Herrington |
| 8,266,856 | B2 | 9/2012 | Carlson et al. |
| 2002/0194795 | A1 | 12/2002 | Spite |
| 2004/0224141 | A1 | 11/2004 | Seiling |
| 2005/0242456 | A1 | 11/2005 | Seilin et al. |
| 2007/0172315 | A1 | 7/2007 | Barrett et al. |
| 2009/0241447 | A1 | 10/2009 | Vollan |
| 2013/0014453 | A1 | 1/2013 | Hargrave et al. |
| 2015/0040509 | A1 | 2/2015 | Peltola et al. |
| 2016/0040384 | A1 | 2/2016 | Wagner |

FOREIGN PATENT DOCUMENTS

| | | |
|---|---|---|
| CN | 209082485 | 7/2019 |
| JP | S58173219 | 10/1983 |
| KR | 20080039020 | 5/2008 |

* cited by examiner

EXTRUDED FRICTIONALLY-ENHANCED REINFORCED PILE

RELATED APPLICATION

This application is a continuation in part of U.S. nonprovisional application Ser. No. 16/722,892 filed Dec. 20, 2019, and issued as U.S. Pat. No. 11,186,961, which is a nonprovisional and claims the benefit of priority of U.S. provisional application 62/785,749 filed Dec. 28, 2018, the entire contents of which are incorporated herein by this reference and made a part hereof.

FIELD OF THE INVENTION

This invention relates generally to structures for construction, and, more particularly, to a cost-effective, extruded, internally reinforced and frictionally-enhanced pile that (a) is impervious or highly resistant to marine life; (b) does not contain toxic chemicals that may leach into water; (c) is relatively easy to lift and maneuver; (d) is capable of being cut and drilled using conventional hand tools; (e) can be driven in the same manner as a conventional wood pile; (f) provides similar or greater frictional resistance than a conventional wood pile; (g) can withstand the elements, weather and radiation from the sun for decades; and, (h) in marine applications, provides equal or greater resistance to uplift than the resistance provided by a convention wood pile.

BACKGROUND

Wood piles have been used for many years to support piers, wharves and the like. In residential marine structures, wood piles have been favored over concrete piles for lower cost and ease of transportation and installation. A buoyant wood pile can be floated to an installation location, placed without use of heavy cranes that are required to move and install concrete piles, and installed and finished with use of conventional drills, screws and saws.

Unfortunately, wood piles are subject to many hazards that eventually necessitate replacement. One major source of damage is marine life. Parasites and microorganisms are particularly troublesome. By way of example, marine organisms such as limnoria and shipworms are prevalent in salt and brackish waters and commonly infest submerged wooded structures seriously sapping the strength and life of the structures. Limnoria is a genus of crustaceans commonly known as gribbles. When they attack a pile, their tunnels almost touch, so the thin walls between them are quickly worn away by wave action, leaving a new surface of wood ready for reinfestation. Shipworms will attack any untreated wood, with the attack destroying more than one-half of the volume of a pile without any evidence of injury being apparent on the pile's surface. Even wood treated with modern eco-friendlier treatments is not impervious to marine organism attack. The expected life of a wood pile used in marine applications today is less than a decade, and in many cases no more than, and likely less than, five years.

In the past, wood preservatives, i.e., chemical pesticides, were freely applied to wood to protect it from decay brought about by fungi and organism attack. The most effective treatments, forced preservative solutions deeply into the wood under high pressure. Creosote, pentachlorophenol, and inorganic arsenicals such as chromated copper arsenate (CCA) were the three most widely used wood preservative compounds. Scientists, environmentalists and regulators eventually expressed concern that when preserved wood was used for in-water construction such as piles, break walls, abutments, or other submerged or partially submerged structures, the toxic preservatives leached from the wood, contaminating water, harming marine life and posing health risks. Today, the use of such preservatives in marine construction is regulated by federal, state and local authorities, generally restricting or prohibiting their use.

Many wood piles are driven to a depth where the pile is capable of supporting a design load (or a multiple of the design load, e.g., 3× design load), without further appreciable descent. Friction between the subterranean portion of the driven pile and the earth in combination with end bearing resists further descent. This depth may be determined by monitoring the movement of the pile with each blow, or after a series of blows, from a pile driving hammer that applies a force greater than the design load.

Conventional wood piles are subjected to forces from wind and water, in addition to the downward force of the supported weight (e.g., the weight of a supported portion of a dock). Wind and water forces may cause uplift, dislodging the embedded (subterranean) portion of the pile. Designers of docks rely upon the weight of the pile and the weight supported by a wood pile, and friction between the wood pile and the earth, to resist uplift forces imparted by wind and water.

What is needed is a cost-effective pile that (a) is impervious or highly resistant to marine life; (b) does not contain toxic chemicals that may leach into water; (c) is relatively easy to lift and maneuver; (d) is capable of being cut and drilled using conventional hand tools; (e) can be driven in the same manner as a conventional wood pile; (f) provides similar or greater frictional resistance than a conventional wood pile; (g) can withstand the elements, weather and radiation from the sun for decades; and, (h) in marine applications, provides equal or greater resistance to uplift than the resistance provided by a convention wood pile.

The invention is directed to overcoming one or more of the problems and solving one or more of the needs as set forth above.

SUMMARY OF THE INVENTION

To solve one or more of the problems set forth above, in an exemplary implementation of the invention, a pile is provided. A pile according to principles of the invention is comprised of a pipe, i.e., a hollow tube, with a coextensive internal reinforcement comprised of a plurality of intersecting walls, such as, by way of example, a plurality of intersecting walls forming a hexagram, spoked-hub, egg crate or honeycomb cross-section. Other polygonal and nonpolygonal shapes of internal reinforcing walls are possible, within the scope of the invention.

The pile is comprised of a thermoplastic, such as polyvinyl chloride (PVC), with chopped strand glass fibers (i.e., short strands of glass fibers). The thermoplastic, pelletized glass fibers and additives are mixed together and extruded. An outer layer, i.e., a cap stock, that enhances impact resistance, provides protection from ultraviolet radiation, and reflects infrared radiation is also provided via coextrusion. Additionally, the cap stock may contain a colorant.

In one embodiment a plurality of continuous reinforcements (e.g., continuous reinforcements in the form of continuous strands (rovings) or plys (mats, fabrics and veils)) extend axially, beneath the cap stock, e.g., through the pipe (or at the outer surface of the pipe between the pipe and cap stock), coextensive with the pipe. The plurality of continuous reinforcements may being be incorporated into the pile via pultrusion.

Frictional enhancement is provided by the glass fibers. The cap stock is relatively smooth, due to the omission of pellets and glass fibers and sizing of the extrudate. During sizing the extrudate passes through rings or a sleeve designed to ensure a consistent outer diameter or width, within a determined range, without projections or surface irregularities. Therefore, the outer surface does not provide sufficient frictional resistance to mimic a wood pile. However, because some of the pelletized glass fibers remain intact in the extrudate, the interior surfaces (interior walls) are bumpy, uneven, not planar smooth. The interior surfaces are not smoothed in the sizing operation. Pelletized clumps of fibers (e.g., clumps about the size of a grain of rice) in the extrudate contribute to the bumpiness. The bumps are perceptible and palpable. Additionally, during extrusion, much of the pelletized glass fiber is broken apart into separate strands. Many strands extend to the surfaces of the interior walls. Portions of reinforcing fibers contained in the extruded plastic are palpable at the wall surface. The surfaces of the interior walls feel rough to the touch, because portions of the fibers (e.g., fiber ends) reach the surfaces of the walls. Such strands impart a rough, slightly furry, texture to the interior wall surfaces. The bumpiness and roughness provide enhanced friction. The enhanced friction equals or exceeds the skin friction of a comparably sized wood pile. The coefficient of friction of the rough interior surface and rough wall surfaces exceed the coefficient of friction of the cap stock, is at least equal to the coefficient of friction of a wood pile in soil, is at least 0.5. Thus, skin friction caused by the rough interior surface and rough wall surfaces exceeds the skin friction caused by the smooth cap stock. Portions of chopped strand glass fibers extending from the interior surface and wall surfaces. In embodiments with pelletized chopped strand, some intact pellets contribute to bumpiness of the interior surface and wall surfaces. Concomitantly, the surface area of the rough interior surface and rough wall surfaces exceed (e.g., by more than 2 or 3 times) the surface area of the exterior surface of the cap stock. The coefficient of friction and surface area of the rough surfaces contribute to the skin friction caused by the rough surfaces. The exterior surface of the cap stock is smooth because it is substantially free of projections and irregularities because it has passed through sizing equipment.

The surface area of the internal walls equals or exceeds the surface area of the exterior wall of the extruded pile. This arrangement is instrumental in attaining frictional force that equals or exceeds the friction force between a conventional wood pile and the earth. The friction allows a length of extruded pile comparable to the length of a conventional wood pile to be driven to about the same depth as the wood pile to carry the same or a greater load as the wood pile.

Optionally, grooves are formed in the bottom portion of the outer (and/or inner) surface of the pile. Such grooves are cut into the pile after extrusion. A machine includes a cutting motor, a rotating cutter wheel and an actuator that moves the cutting motor and rotating cutter wheel towards the surface of the pipe to be grooved. The actuator and cutting motor are mounted to a sleeve that revolves around the extruded pipe. A slip ring supplies electric power to the actuator and cutting motor. A drive motor drives the sleeve.

The grooves may comprise a continuous thread-like spiral groove, or separate spaced apart (e.g., parallel) grooves. The grooves provide a rough surface that resists uplift when the bottom portion of the pile is embedded in the earth (e.g., a sea bed). Without the grooves, uplift could pose a serious problem for a smooth surfaced constant diameter pile. Optionally, for further frictional resistance to uplift, a similar machine with a wire wheel instead of a cutter may be used to roughen the surface of the grooved portion. Alternatively, the grooves and roughening may be formed manually using hand tools.

An exemplary integrally formed extruded pile includes an outer pipe structure having an outer diameter or width of at least four inches (e.g., 6, 8 or 12 inches), and defining an interior space, and having a length from a first end to an opposite second end. A plurality of intersecting walls is formed within the interior space. The intersecting walls are coextensive with the outer pipe and form a plurality of spaced apart trusses or braces that intersect and support the outer pipe. In some embodiments, a groove is cut in the outer pipe adjacent to the first end. The extruded pile is comprised of a blend of polyvinylchloride and chopped strand glass fibers having diameters of 5 to 18 μm and strand lengths of 0.125 to 0.50 inches. The glass fibers comprise 20 to 50% by weight of the blend. The extruded pile also includes an outer layer formed by coextrusion. The outer layer comprises an infrared radiation inhibitor, such as titanium dioxide or zinc dioxide. The outer layer may further include an impact modifier. In one embodiment, the exterior groove is a continuous spiral groove extending from the first end to a position along the length, the position being between a midpoint of the length and the first end.

In one embodiment, the pile includes trusses, which include vertices, a plurality of spaced apart vertices, with each vertex equally spaced apart from another vertex. The plurality of spaced apart vertices may comprise at least 5 spaced apart vertices.

In one embodiment, the intersecting walls of the pile form a hexagram cross-section shape. The hexagram cross section shape includes six vertices. Each vertex of the six vertices intersects the outer pipe and is evenly spaced apart from adjacent vertices. Each vertex is also directly opposite another vertex.

The outer pipe may have a wall thickness of 0.25 to 0.50 inches. Each wall of the plurality of intersecting walls within the interior space may have a wall thickness of 0.125 to 0.5 inches.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

An exemplary pile according to principles of the invention is comprised of a pipe, i.e., a tube, with a coextensive internal reinforcement comprised of a plurality of intersecting walls. In the example provided in FIG. 1, the tube has an annular cross-section. The intersecting walls form a hexagram cross-section. The hexagram includes 6 vertices. Each vertex intersects the pipe. Adjacent intersections are evenly spaced around the annular cross-section.

Figure 1:
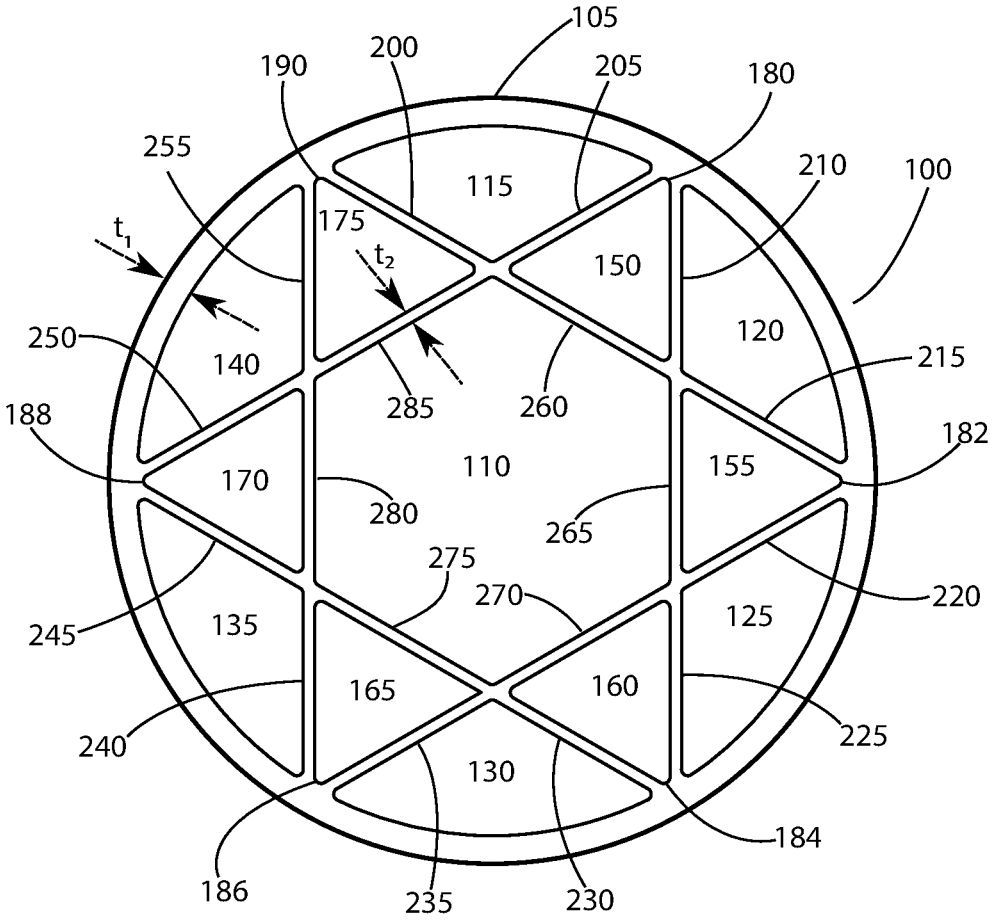
FIG. 1 is a plan view of an exemplary pile with an internal wall structure according to principles of the invention.
Figure 3:
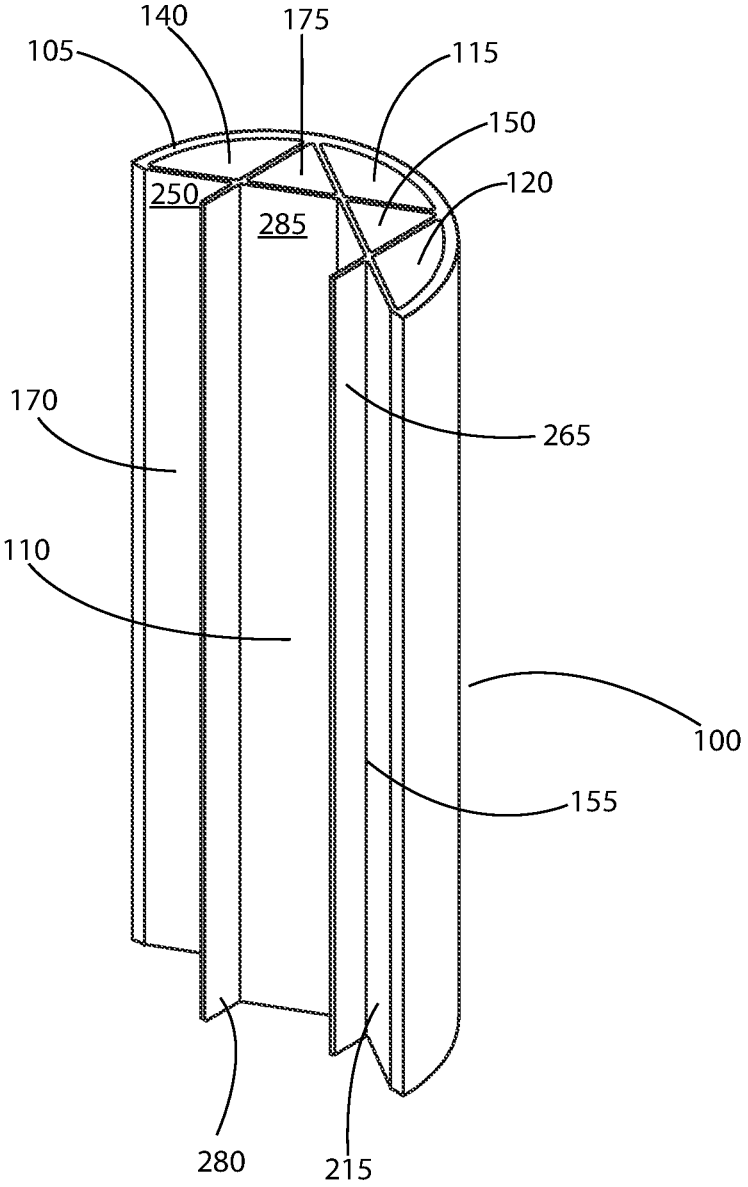
FIG. 3 is a perspective section view of an exemplary pile according to principles of the invention.

With reference to FIG. 1 and the corresponding section view of FIG. 3, the outermost portion of the pile 100 is a hollow pipe of annular cross section 105. As discussed below, tubes having non-annular cross sections (e.g., rectangular or square) may be used within the spirit and scope of the invention. As discussed below, the pipe may include a plurality of co-extruded layers.

The exemplary hexagram is a six-pointed geometric star figure, more particularly, a compound figure of two overlapping equilateral triangles with their intersection forming a regular hexagon and each vertex of one equilateral triangle being directly opposite a vertex of the other equilateral triangle. One equilateral triangle is formed of a first side comprised of walls 255, 280, 240; and second side comprised of walls 200, 260, 215; and a third side comprised of walls 220, 270, 235; and a first vertex 190 between the first and second sides; a second vertex 182 between the second and third sides; and a third vertex 186 between the first and third sides. The other equilateral triangle is formed of a first side comprised of walls 250, 285, 205; and second side comprised of walls 210, 265, 225; and a third side comprised of walls 230, 275, 245; and a first vertex 180 between the first and second sides; a second vertex 184 between the second and third sides; and a third vertex 188 between the first and third sides.

The hexagon 110 occupies the center of the cross section. Walls 260, 265, 270, 275 and 280 define the hexagram. Each such wall also is a wall of a smaller triangle, as discussed below.

All three sides of each equilateral triangle are equal. Each vertex is a point where two lines of the equilateral triangle meet. Internal angles at each vertex are congruent to each other and are each 60°. The cross-section of the pipe is an annulus 105 that passes through all three vertices of each equilateral triangle. The inner radius, r, of the annulus is:

$$r=a/\sqrt{3}$$

The variable a is the length of a side of the equilateral triangle. For example, the length of one side, is the sum of the lengths of walls 255, 280 and 240. All three sides of each equilateral triangle are equal in length.

The overlapping equilateral triangles form 6 smaller equilateral triangles. One such triangle is defined by walls 200, 255, 285, defining a triangular space 175 therebetween. Another such triangle is defined by walls 205, 210, 260, defining a triangular space 150 therebetween. Another such triangle is defined by walls 215, 220, 265, defining a triangular space 155 therebetween. Another such triangle is defined by walls 225, 230, 270, defining a triangular space 160 therebetween. Another such triangle is defined by walls 235, 240, 275, defining a triangular space 165 therebetween. Another such triangle is defined by walls 245, 250, 280, defining a triangular space 170 therebetween.

Each side of each equilateral triangle is a chord, i.e., a straight line with endpoints that lie on the annulus. Two pie slice sections and one of the smaller triangles between the two pie slice sections are between the chord and the perimeter of the annulus 105. For example, chord 255, 280, 240 and the arc of the annulus 105 extending from vertex 186 to vertex 190 enclose triangle 170 between pie sections 135 and 140. Chord 250, 285, 205 and the arc of the annulus 105 extending from vertex 188 to vertex 180 enclose triangle 175 between pie sections 140 and 115. Chord 200, 260, 215 and the arc of the annulus 105 extending from vertex 190 to vertex 182 enclose triangle 150 between pie sections 115 and 120. Chord 210, 265, 225 and the arc of the annulus 105 extending from vertex 180 to vertex 184 enclose triangle 155 between pie sections 120 and 125. Chord 220, 270, 235 and the arc of the annulus 105 extending from vertex 182 to vertex 186 enclose triangle 160 between pie sections 125 and 130. Chord 230, 275, 245 and the arc of the annulus 105 extending from vertex 184 to vertex 188 enclose triangle 165 between pie sections 130 and 135.

Each of the smaller equilateral triangles share a side with the hexagon 110 formed by the two overlapping equilateral triangles, as discussed above. Wall 260 is shared by the hexagon 110 and triangle 150. Wall 265 is shared by the hexagon 110 and triangle 155. Wall 270 is shared by the hexagon 110 and triangle 160. Wall 275 is shared by the hexagon 110 and triangle 165. Wall 280 is shared by the hexagon 110 and triangle 170. Wall 285 is shared by the hexagon 110 and triangle 175.

Each vertex 180, 182, 184, 186, 188 and 190 of each equilateral triangle intersects the annular cross section pipe 105. The intersections are evenly spaced about the annulus 105. Thus, the angle formed by radii extending from the center of the annulus to each adjacent vertex is 60°. For example, the angle between radii extending from the center to vertex 180 and from the center to vertex 182 is 60°.

The arclengths between adjacent vertices are equal. The arc extending from one vertex to another adjacent vertex subtends an angle of 60° with the annulus center. Each such arclength is:

$$L=\theta\cdot r$$

The variable θ is the subtending angle in radians and r is the radius. A subtending angle of 60° is equal to 1.0472 radians. Thus, arclength of each arc extending between each pair of adjacent vertices is 1.0472·r. For example, the arc extending from vertex 180 to vertex 182 is the product of 1.0472 and the radius, r, of the annulus 105.

Wall thicknesses may vary. In one nonlimiting exemplary embodiment, the thickness, $t_1$, of the circular wall 105 is 0.25 to 0.50 inches and the thickness, $t_2$, of each wall of the hexagram is 0.125 to 0.5 inches. An outer layer (i.e., cap stock) providing an additional thickness of about 0.01 to 0.10 inches may be co-extruded on the pipe. In a particular nonlimiting exemplary embodiment, the thickness, $t_1$, of the circular wall 105 is about 0.480 inches, including a coextruded protective outer layer (i.e., a co-extruded cap), and the thickness, $t_2$, of each wall of the hexagram is about 0.180 inches. More specifically, the circular wall may be comprised of a base portion having a thickness of 0.460 inches and a coextruded cap having a thickness of 0.020 to 0.090 inches (e.g., 0.060 inches).

Figure 2:
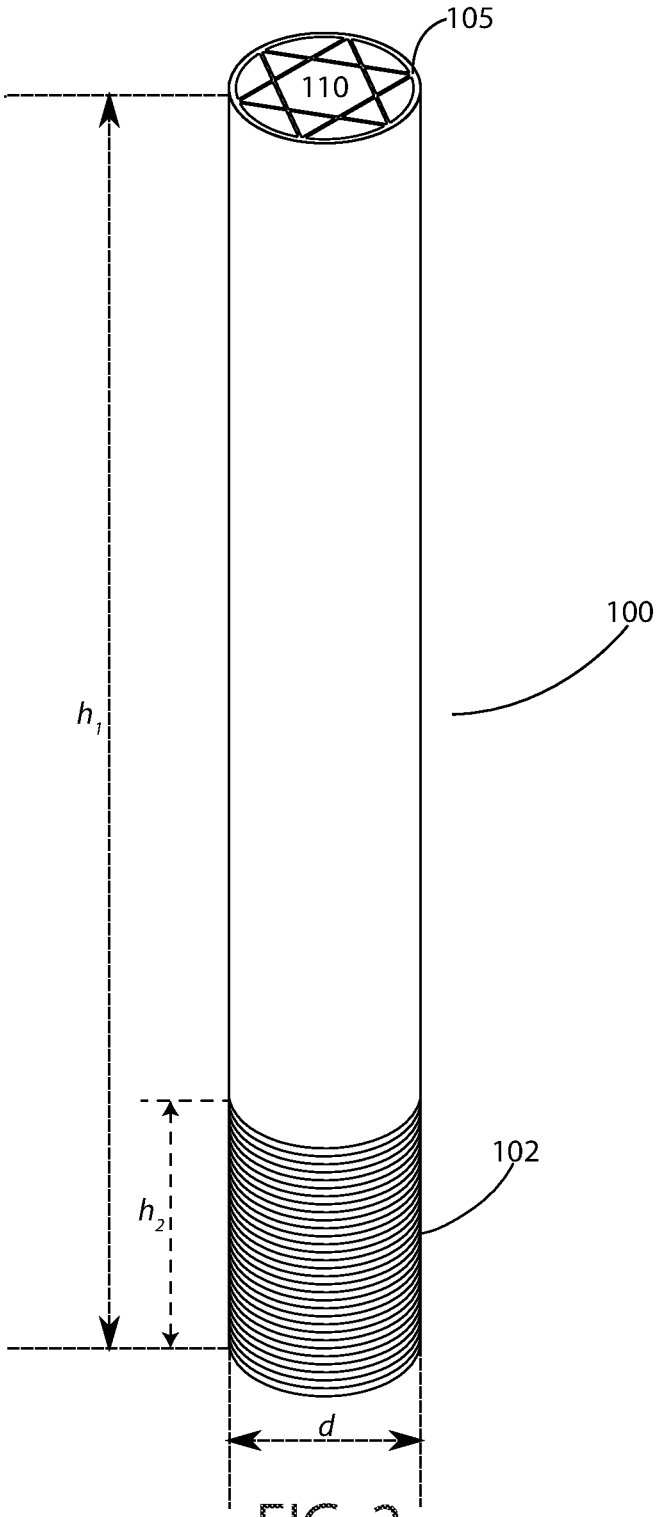
FIG. 2 is a perspective view of an exemplary pile according to principles of the invention.
Figure 4:
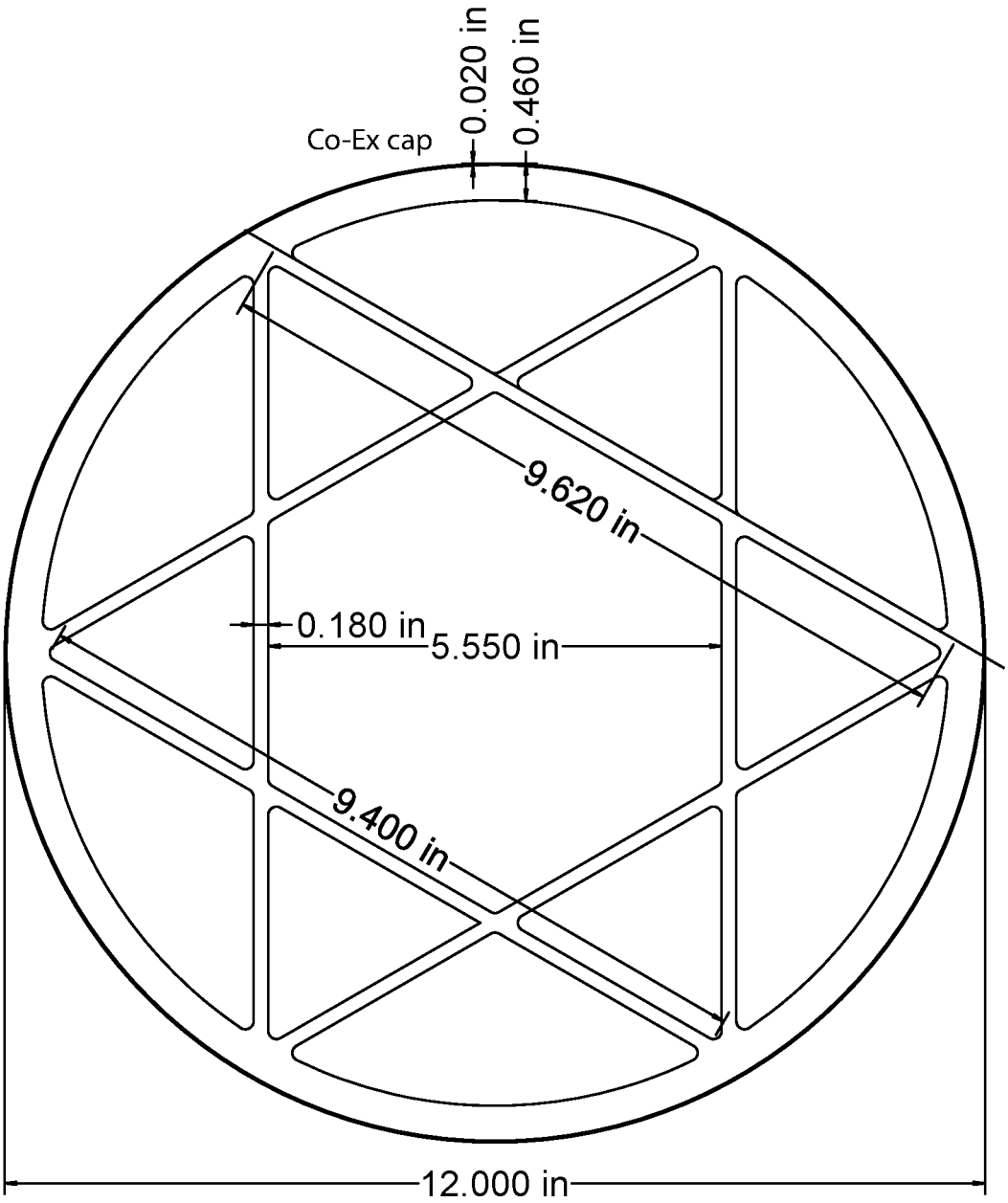
FIG. 4 is a dimensioned plan view of an exemplary pile according to principles of the invention.

With reference to FIG. 2, outer diameter, d, of the circular portion 105 may vary. In one nonlimiting exemplary embodiment, the outer diameter, d, is about 8 to 16 inches. In a particular nonlimiting exemplary embodiment, the outer diameter, d, is about 12 inches. Nonlimiting examples of dimensions are provided in FIG. 4. As used herein, about means ±10%.

A pile 100 according to principles of the invention may be sized to replace a conventional pile. Thus, a pile 100 according to principles of the invention, may have the same length, $h_1$, as a conventional wood, concrete or metal pile. Additionally, a pile 100 according to principles of the invention may be cut to a desired length using conventional cutting tools for a wood pile.

Furthermore, a pile 100 according to principles of the invention may have a grooved section 102 at one end of the pile, extending from about the end of the pile to a distance $h_2$. The distance $h_2$ is less than half, and preferably no more than a third or quarter, of the total length, $h_1$. All or a substantial portion of the portion of the pile embedded in the sea bed preferably includes grooves. The grooves resist uplift. Piles according to principles of the invention that are not subjected to uplift forces may omit the grooved section.

Uplift refers to an upward (i.e., vertical) vector component of a force acting on a pile. Such a force may, for example, be due to buoyancy, seismic activity, soil dynamics in the seabed, fluid forces from wave and/or wind action, and interaction with boats. Without adequate resistance to uplift, an end of a pile may become dislodged from the sea bed, upon which the pile will cease to provide structural support. Without grooves or other roughening at the embedded end of the pile, the pile, with its smooth outer and inner surfaces and constant diameter, would provide minimal resistance to uplift. With an embedded grooved end, the pile resists uplift as well as, or better than, conventional wood piles.

A jetting wand may be extended through the central hexagon 110, from one end of the pile to the opposite end of the pile 100. A jetting wand is used for installation of the pile 100 by water jetting. Such jetting utilizes a pressurized flow of water to disturb soils beneath the pile 100. Jetting liquefies the disturbed soil, reducing the friction and interlocking between adjacent soil particles. This greatly decreases the bearing capacity of the soil below the pile 100, allowing the pile 100 to descend with minimal net downward force.

While conventional pile jetting entails use of a wand to direct a jet of water around the periphery of the bottom of a pile, a pile 100 according to principles of the invention directs the jet directly beneath the bottom of the pile 100. This results in more effective jetting installation with reduced disturbance to soil surrounding the pile 100. The surrounding soil that is left substantially undisturbed provides superior support to the descended portion of pile 100. While not preferred, a compressed air jet may be used instead of a pressurized water jet with the same or similar end result.

In an exemplary embodiment, the pile 100 is comprised of an extruded rigid thermoplastic, e.g., polyvinylchloride (PVC), with glass fiber reinforcement. PVC is advantageous because it is relatively inexpensive, resistant to environmental degradation (as well as to chemicals and alkalies), exhibits high hardness for a plastic and outstanding tensile strength for a plastic. PVC is also widely available, commonly used, easily recyclable and readily available as a recycled material. However, the invention is not limited to PVC. Other extrudable thermoplastics, such as, but not limited to, acrylonitrile butadiene styrene (ABS), polyoxymethylene (POM), and polyolefins, such as, but not limited to, polyethylene (e.g., high density polyethylene) and polypropylene, may be used within the spirit and scope of the invention.

The thermoplastic material without fiber reinforcement is the matrix. The extent that strength and rigidity are enhanced in the fiber-reinforced plastic depends on the mechanical properties of both the fiber and matrix, their volume relative to one another, and the fiber length and orientation within the matrix. In the exemplary embodiment, the fibers assume orientations achieved during the extrusion process. Examination has shown that, upon extrusion, the fibers are oriented in various directions, some aligned with the direction flow, and some not aligned with the direction of flow. This "random" orientation is considered advantageous because it provides structural enhancement in all directions.

PVC has a very high viscosity in the processing range. The high viscosity complicates processing with added reinforcing fibers. To improve processing, additives may be introduced into the mix. An exemplary PVC matrix may be a commercially available, free flowing, granular powder. Additives, such as one or more plasticizers, such as, but not limited to, dioctyl terephthalate (DOTP), may be used to decrease the viscosity of the mix and to improve flexibility and durability.

Another additive, a lubricant may be used to reduce friction between the processing machinery and the plastic materials, between the molecules of the plastic materials and between the molecules of the plastic materials and the fiber reinforcements. The lower the friction, the better the processing properties of the underlying plastic. ORC-A (calcium acetylacetonate) is one nonlimiting example of a lubricant.

Another additive, a heat stabilizer, may be used to greatly increase the heat stability of PVC, such as scavenging of HCl molecules released during processing. Without a heat stabilizer, when PVC is exposed to heat (>100° C.), HCl is eliminated from the polymer backbone, which triggers a further autocatalytic degradation process, causing rapid discoloration and embrittlement of the PVC. A nonlimiting example of a heat stabilizer is barium-zinc, calcium-zinc or aluminum magnesium carbonate hydroxide (hydrate) additive.

Another additive, an impact modifier, may be used to improve durability and toughness. In addition to the impact performance, a number of other characteristics such as tensile properties, weatherability, processability, flammability, and heat distortion can be improved by adding an impact modifier. A nonlimiting example of an impact modifier is precipitated calcium carbonate (PCC).

As a reinforcement and friction enhancer, chopped strand fibers, i.e., glass fibers, are added. The fibers generally contain oxides of silicon, calcium, aluminum, magnesium and/or boron. By way of example and not limitation, the fibers may comprise E-glass, which is alumino-borosilicate glass with less than 1% (by weight) alkali oxides. The fibers are small diameter (e.g., about 5 to 18 μm) strands, each having a short length (e.g., about 0.125 to 0.50 inch).

In a preferred embodiment, pelletized glass fibers are used. Each pellet, about the size of a grain of rice, is a clump of individual short strands of glass fibers. These pelletized clumps of fibers in the extrudate contribute to bumpiness of the extruded product. The bumps are perceptible and palpable. During extrusion, some pellets remain intact while others are broken apart with the clumps becoming separate strands. Many strands extend to the surfaces of the interior walls. Portions of such strands contained in the extruded plastic are palpable at the wall surface. The surfaces of the interior walls feel rough to the touch, because portions of the fibers (e.g., fiber ends) reach the surfaces of the walls. Such strands impart a rough, slightly furry, texture to the interior wall surfaces. The bumpiness from the intact pellets and roughness from the separated strands provide enhanced friction, i.e., enhanced skin friction. The coefficient of friction (determined in accordance with ASTM D1894-14) and the enhanced skin friction equal or exceeds the friction coefficient and skin friction of a comparably sized wood pile.

Timber piles are often comprised of southern yellow pine. Such pine wood may exhibit average surface roughness $R_a$ in the range of 2.5 to 4.0 μm. The average surface roughness of the interior surfaces of a pile according to principles of the invention may equal or exceed the average surface roughness of pine.

The glass fibers comprise a substantial portion of the mix to be extruded. The glass fibers comprise approximately 20-50% (by weight) of the extruded material (excluding the co-extruded cap stock). In a particular exemplary embodiment, the glass fibers comprise 30% (by weight) of the extruded material (excluding the co-extruded cap stock).

The ingredients for the mix are introduced into a vessel, before extruding. Then they are mixed. Any mixing apparatus suitable for blending solids may be used. Before extrusion, the mix should be substantially homogeneous. Thus, two samples of equal volumes from different parts of the mix should exhibit the same or closely similar masses, and the same or closely similar concentration of each ingredient (e.g., PVC, each additive and reinforcing fibers).

In an exemplary implementation, to produce a pile 100 according to principles of the invention, a PVC pipe with a coextensive internal reinforcing structure (e.g., the hexagram structure described above) is extruded. A protective outer layer is coextruded with the pipe. The pile may be cut to a desired length.

Unplasticized PVC (PVC-U) is hard and brittle. An important characteristic of PVC is the glass transition temperature, $T_g$, which describes the significant change of a hard and stiff material behavior to a tough and soft one. This temperature is not a sharp point but a temperature range. For PVC-U the glass transition is at about 80° C., 176° F. However, by adding plasticizers, the stiffness and the glass transition temperature can be reduced significantly.

PVC pipe may experience a substantial reduction in rigidity if stored outdoors in a hot climate. Infrared radiation from the sun will heat the pipe. If the pipe is stored horizontally, heat collects within the pipe. Over time, the temperature of the pipe may approach or even exceed the glass transition temperature, especially if the pipe includes plasticizer and is stored on blacktop.

The outer layer may incorporate PVC, colorants, one or more IR and UV inhibitors, and impact modifiers. Titanium dioxide, zinc dioxide and other infrared reflecting pigments are highly effective for inhibiting degradation from infrared radiation. Such additives provide a cooling effect vi reflection, which helps keep the pile below the glass transition temperature. The outer layer, which is devoid of glass fibers, prevents spalling from the inner layer containing glass fibers. The outer layer may also include a relatively high concentration of impact modifiers to reduce brittleness, while shielding the inner layer from degradation that may otherwise increase its brittleness.

If the ends of the pile are capped, the pile will be buoyant. If so, it can be floated into position. Caps may be removed before installation.

The pile is relatively lightweight. It can be maneuvered with the same equipment used for wood piles. It can be drilled using ordinary drill bits suitable for drilling wood. It can be cut using ordinary saw blades suitable for cutting wood. It will not leach toxic chemicals. It will not be susceptible to attack by wood-destroying microorganisms. It possesses adequate structural properties (e.g., compressive strength and modulus of elasticity) that are sufficient for use as a structural pile. Depending upon the particular formulation, the structural properties will at least equal or exceed those for conventional wood piles. Furthermore, it allows efficient installation by water jetting through the central cavities.

Advantageously, a pile according to principles of the invention is impervious or highly resistant to marine life, does not contain toxic chemicals that may leach into water, is buoyant and can be floated into position, is relatively easy to lift using the same equipment used to lift wooden piles, and is capable of being cut, nailed and screwed using conventional hand tools and hardware for wood construction. Additionally, a pile according to principles of the invention is readily configured for water jetting.

Figure 5:
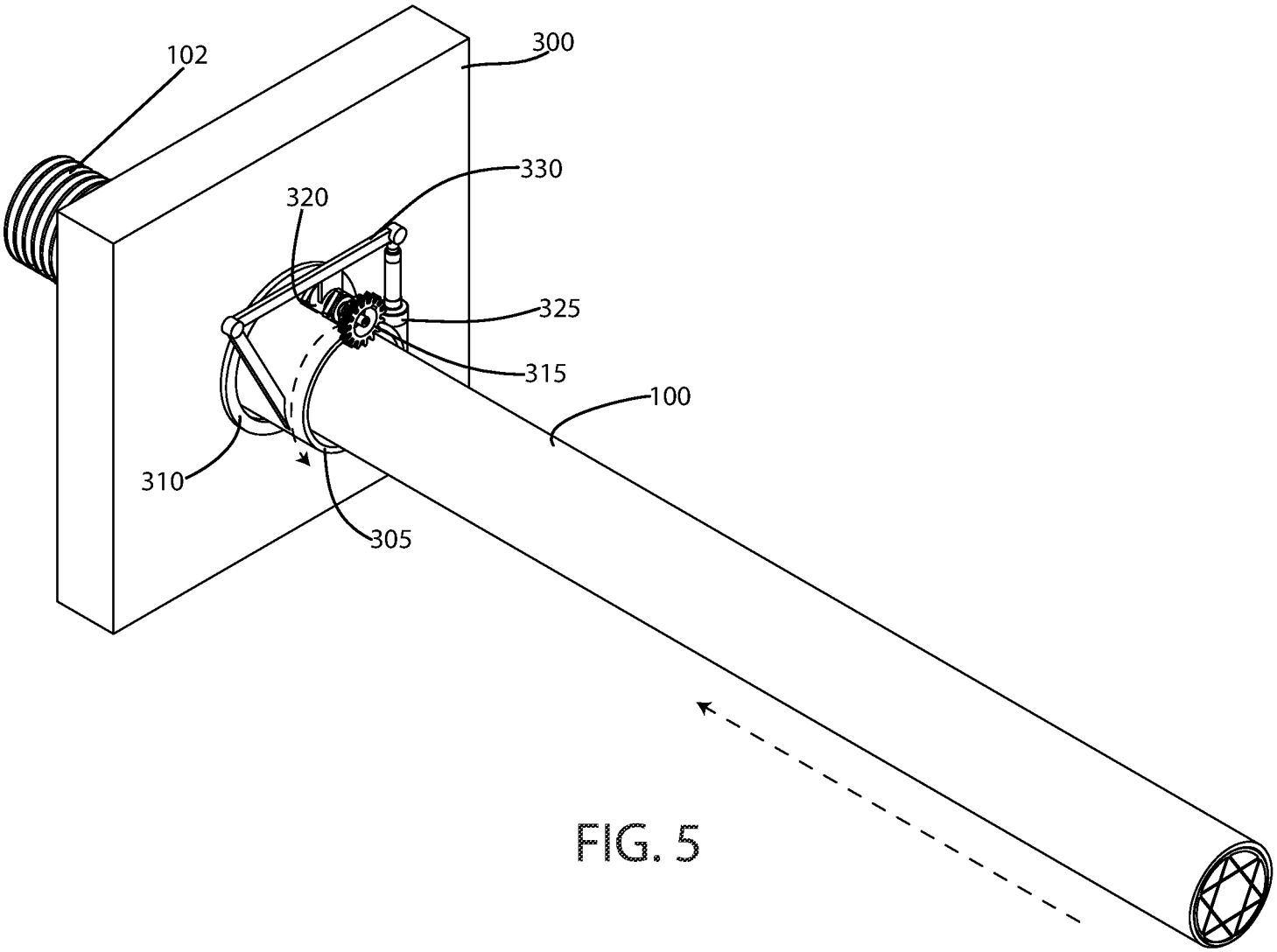
FIG. 5 is a first schematic view of an exemplary pile proceeding through a grooving machine, according to principles of the invention.
Figure 6:
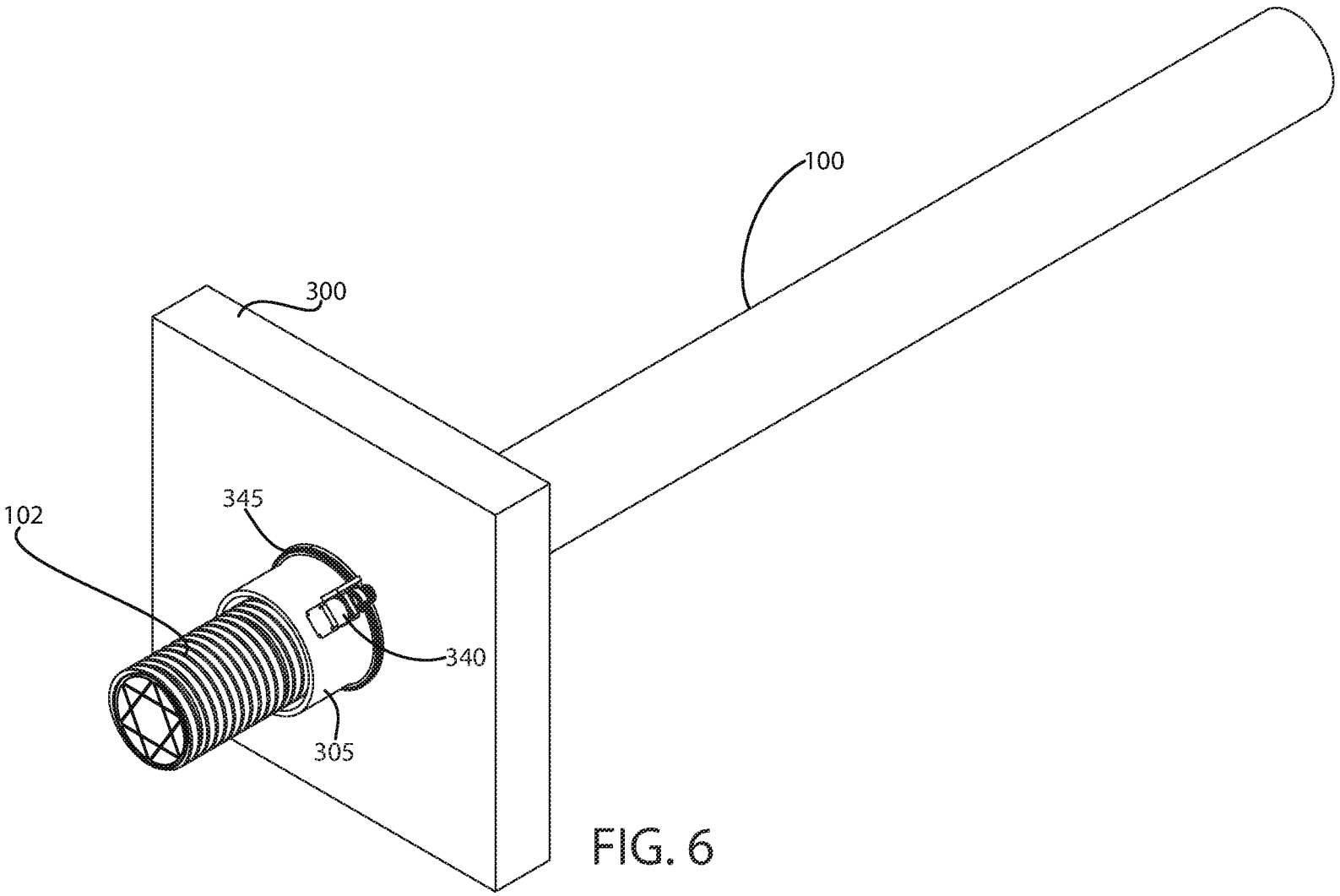
FIG. 6 is a second schematic view of an exemplary pile proceeding through a grooving machine, according to principles of the invention.

Referring to FIGS. 5 and 6, schematics conceptually illustrate a machine for forming grooves 102 in an extruded pile 100 according to principles of the invention. As discussed above, grooves 102 may be formed in the bottom portion of the outer (and/or inner) surface of the pile. Such grooves 102 may be cut or molded into the pile 100 after extrusion. By way of example, a machine may include a cutting motor 320 with a rotating cutting wheel 315 and an actuator 325 (linear actuator) with a pivoting support frame 330 that moves the cutting motor 320 and rotating cutting wheel 315 towards and away from the surface of the pile 100 to be grooved. The rotating cutting wheel 315 may be a dado blade. The depth of the groove is controlled by controlling the position of the cutting wheel 315. In an exemplary implementation, the grooves have a depth of approximately 5% to 25% of the total thickness of the outer wall of the pile. The cutting motor 320 is fixed to a portion of the pivoting support frame 330. The actuator 325, frame 330 and cutting motor 320 are mounted to a sleeve 305 that revolves around the extruded pile 100. The sleeve extends through a passage in a wall 300. A slip ring 310 supplies electric power to the actuator 325 and cutting motor 320. On the opposite side of the wall 300, a drive motor 340 with a drive gear drives a ring gear 335 attached to the sleeve 305. The drive motor 340, which is fixed to the wall 300 causes the sleeve to rotate (i.e., revolve around the pile 100) as the pile 100 passes through the sleeve 305.

In the exemplary implementation, the extruded pile 100 proceeds through the sleeve 305 in the direction shown by the dotted arrow line in FIG. 5. However, the machine may be configured for the pile 100 to proceed through the sleeve in the opposite direction.

The grooves 102 may comprise a continuous thread-like spiral groove, or separate spaced apart (e.g., parallel) grooves. The grooves 102 provide a rough surface that resists uplift when the bottom portion of the pile is embedded in the sea bed. Without the grooves 102, uplift could pose a serious problem for a smooth surfaced constant diameter pile. Optionally, for further frictional resistance to uplift, a similar machine with a wire wheel instead of a cutter 315 may be used to roughen the surface of the grooved portion 102 of the pile. Alternatively, the grooves 102 and roughening may be formed manually using hand tools.

In the exemplary implementation, the wall is stationary. Therefore, the formed groove is a thread-like groove that proceeds in a spiral pattern. The number of threads per unit length depend upon the rate of rotation of the sleeve 305 and the speed at which the pile advances from the extrusion die. Increasing the rate of rotation of the sleeve 305 increases the number of threads per unit length. Decreasing the rate of rotation of the sleeve 305 decreases the number of threads per unit length.

If spaced apart grooves are desired, the wall can be mounted on a track or sled that moves the wall linearly relative to the pile. As the cutter 315 makes a groove, the wall moves at the same speed and in the same direction of the cutter. Then the cutter 315 is positioned for the next groove, and the relative movement is repeated.

In lieu of cutting grooves into the end of the pile, grooves may be molded into the end. Such molding may entail pressing heated ridges into the outer surface of the end of the pile. Ridged molds may be heated above the glass transition temperature of the thermoplastic plastic. Pressing force may be supplied by mechanical, pneumatic or hydraulic actuators. The ridges are a negative of the groove portions.

In FIGS. 5 and 6, the end of the pile 100 opposite the grooved end 102 is shown as a cut end. While the machine may be used with pre-cut piles, in a preferred implementation the machine is incorporated into the extrusion line, after the pile 100 emerges from the die and is cooled, and before the pile 100 is cut. The pile 100 is cut after the groove 102 is formed. Cutting may be accomplished at a station downstream from the grooving machine.

Figure 7:
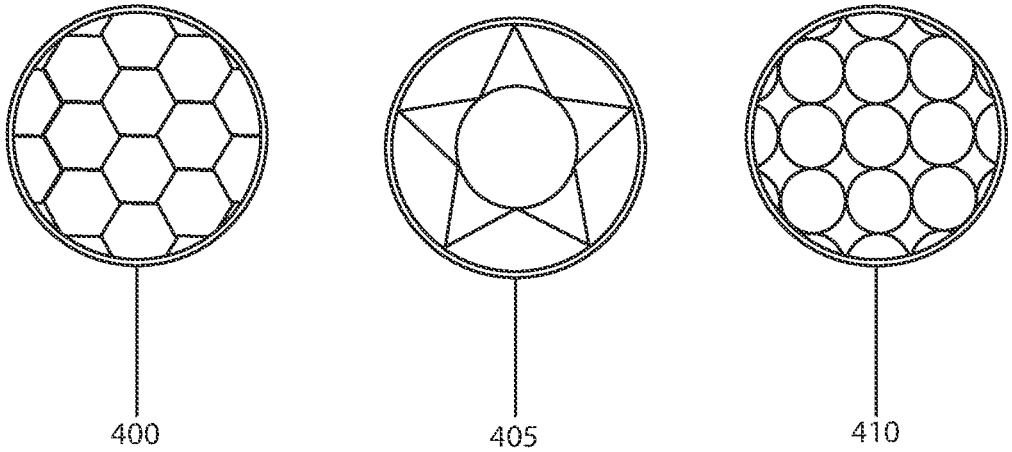
FIG. 7 provides plan views of non-limiting examples of alternative profiles for a pile according to principles of the invention.

Referring now to FIG. 7, nonlimiting examples of other profiles are provided. One profile includes a honeycomb pattern 400, another includes a star pattern with a concentric pipe 405, and another includes repeating pipes and pipe segments 410. Each of these profiles structurally reinforce the pile 100 by providing walls that extend internally from side to side. The interior walls act as trusses, stabilizing the structure and distributing forces.

The invention is not limited to the profiles of FIG. 7, or to the profile illustrated in FIG. 1. While the profile of FIG. 1 is preferred, any profile that includes a plurality of walls extending from side to opposite side of the interior space of the pile, with interior walls that act as trusses, stabilizing the structure and distributing forces, may be used. Such walls may be curved or planar. The patterns may be polygonal, non-polygonal, circular, elliptical or irregularly shaped.

Figure 8:
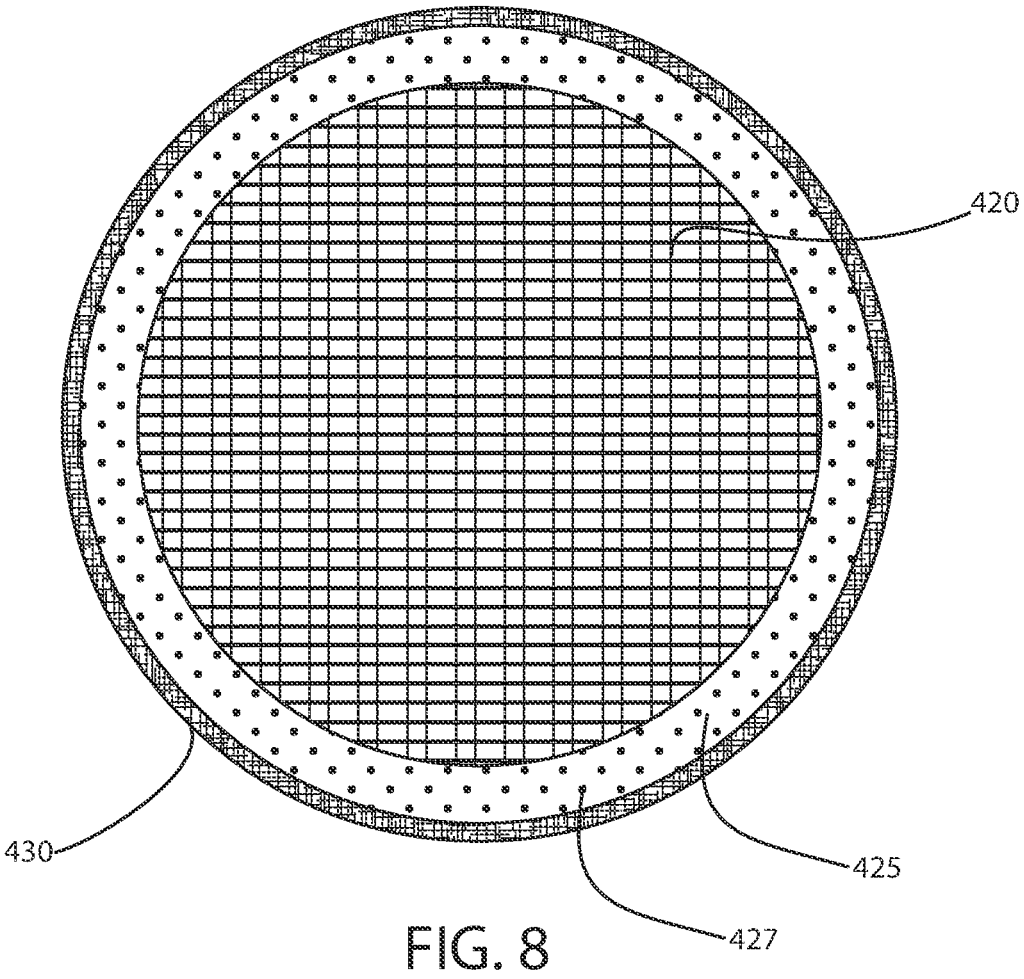
FIG. 8 provides a schematic conceptually illustrating layers of a pile according to principles of the invention.

FIG. 8 conceptually illustrates layers of a pile according to principles of the invention. The interior structure 420, conceptually represented with vertical and horizontal cross hatching, is occupied by a plurality of walls extending from side to opposite side of the interior space of the pile, with interior walls that act as trusses, stabilizing the structure and distributing forces, as described above. The pipe wall 425 is a solid wall in a tubular (hollow elongated cylinder) shape. The interior structure 420 and the pipe wall have the same composition. A cap stock, outer layer 430, is applied on (coextruded over) the solid wall 425. Exemplary thicknesses and compositions of each portion is described above.

Figure 9:
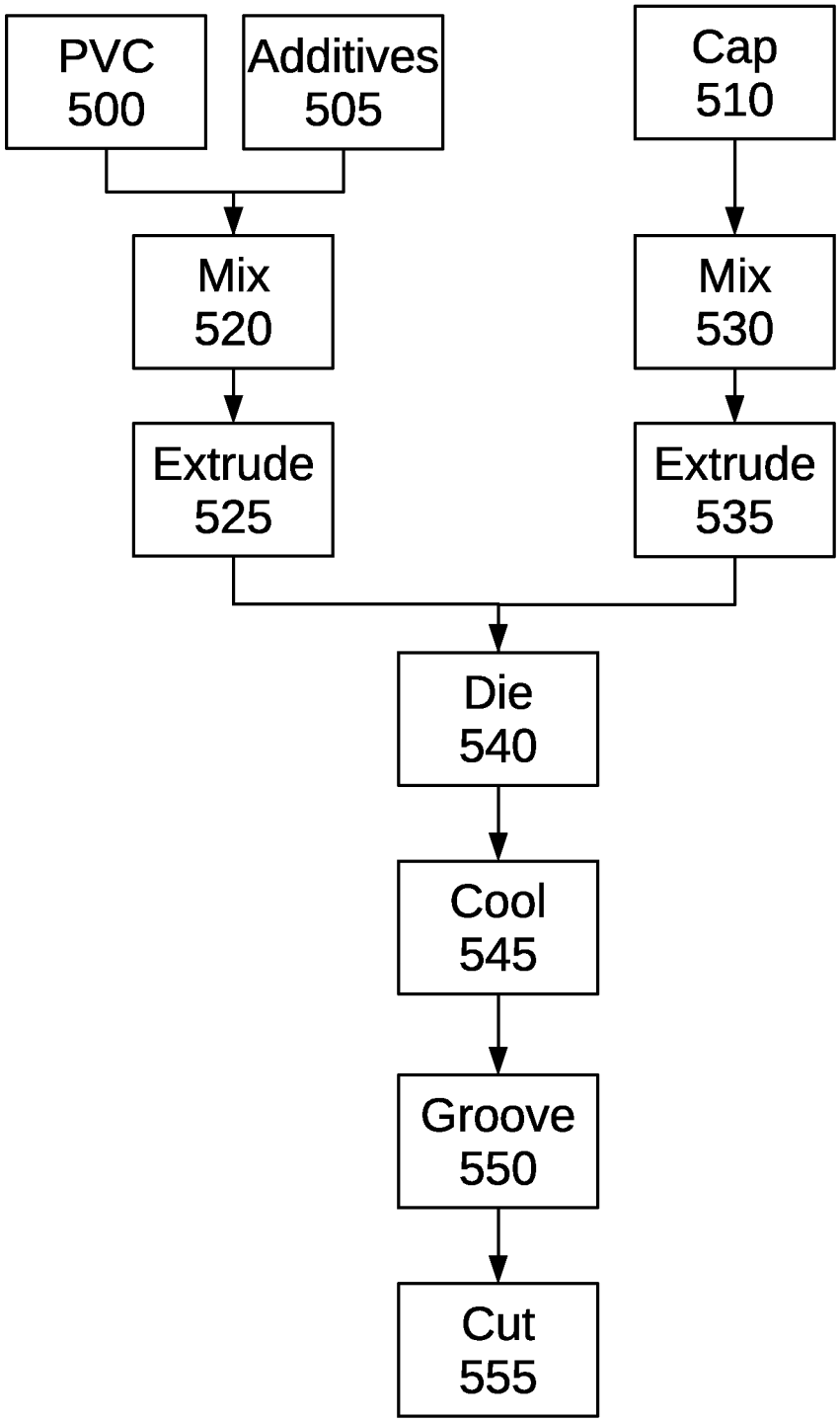
FIG. 9 is a high-level flowchart of steps of an exemplary method of producing a pile according to principles of the invention.

Referring to the high-level flowchart of FIG. 9, thermoplastic (e.g., PVC) 500, such as pellets, compound or recycled material, and additives 505, including glass fibers, are combined and blended in step 520. Alternatively, ingredients may be gravimetrically fed with different feeders directly above the extruder feed throat, assuming there are enough space and feeders to accommodate the various components in the formulation. Concomitantly, components for the cap stock 510 are blended in step 530. The blended components are introduced into their respective extruder, in steps 525 and 535. Such introduction may be accomplished by placing the preblended materials in a hopper over the feed throat, allowing gravity and the screw to feed the formulation to each extruder. After feeding, polymers are melted or plasticated, conveyed forward with contained additives, and melt mixed in the extruder. Each extruder supplies the extrudate to an inlet to the die. The die shapes the extrudates into the desired cross section, as in step 540. The extruded material must then be cooled to its glass transition temperature ($T_g$) to retain its shape. Such cooling, as in step 545, may be accomplished with water, air, or contact with a cold surface.

The extruded plastic remains in the molten state immediately upon its passage out of the extruder. The molten extrudate must experience strictly controlled conditions until it solidifies. Various types of sizing or calibrating tools may be used to accomplish this objective. In an exemplary implementation, the molten extrudate passes through a sizing sleeve in a vacuum sizing tank, which contains a water bath in a negative pressure environment. Upon passage through the vacuum sizing tank, the pile is cooled, and the outer surface of the pile is smooth and precisely sized. However, the interior surfaces are rough, not smooth.

After cooling, a continuous spiral groove (or separate spaced apart grooves) may be cut into a portion of the extruded structure, as in step 550. Equipment and methods for cutting grooves are described above. After groove formation, a pile may be cut to length, as in step 555.

Figure 10:
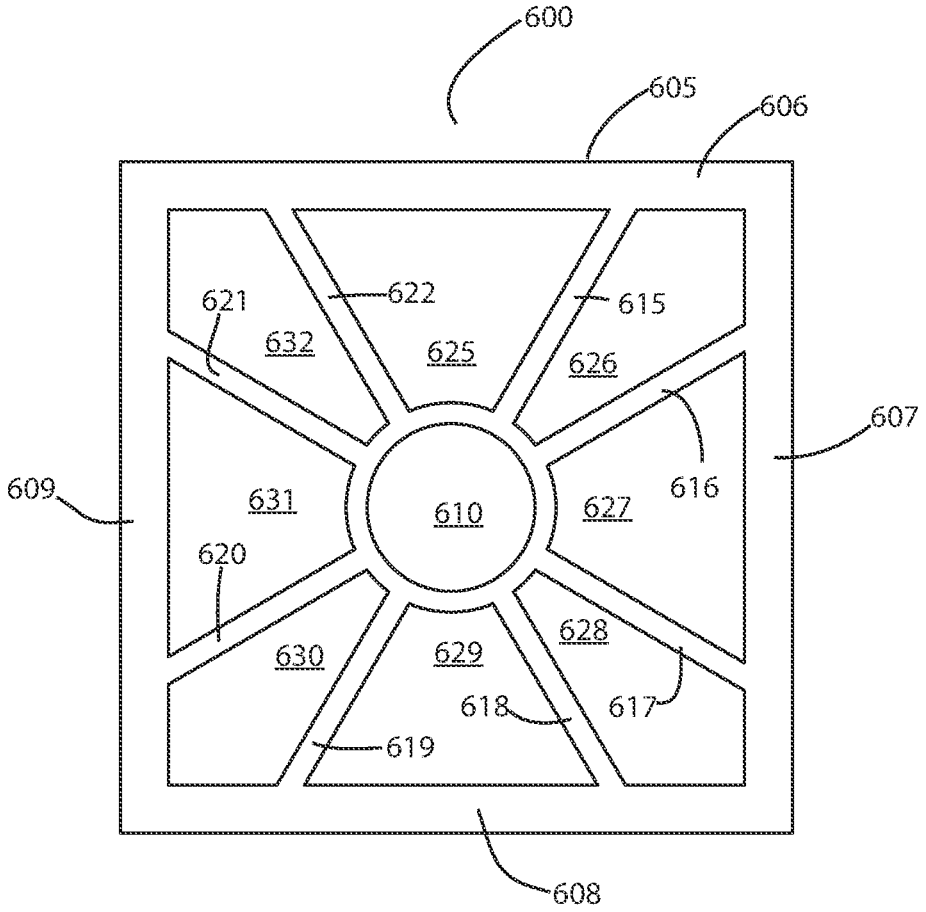
FIG. 10 is a plan view of an exemplary pile with an internal wall structure according to principles of the invention.
Figure 11:
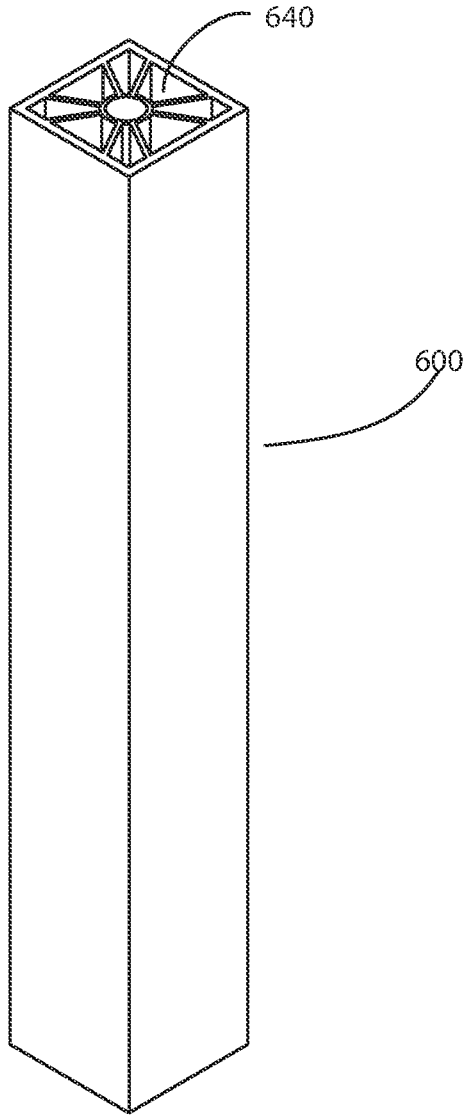
FIG. 11 is a perspective view of an exemplary pile with an internal wall structure according to principles of the invention.

FIGS. 10 and 11 conceptually illustrate an exemplary pile 600 with an internal wall structure according to principles of the invention. The exterior tube 605 has a square profile shape, comprised of walls 606-609. The internal wall structure 640 includes a central hollow cylinder 612 with a plurality of walls 615-622 extending radially from the cylinder 612. Each radially extending wall 615-622 extends to the interior side of the one of the walls 606-609 of the exterior tube 605. The radially extending walls 615-622 converge on the center of the pile 600. Each radially extending wall 615-622 intersects the cylinder 612, and the interior side of the one of the walls 606-609. Thus the walls are "intersecting walls." Additionally, the radially extending walls 615-622 in combination with the cylinder 612 form truss-like members where loads are transmitted from the walls 606-609 through the radially extending walls 615-622 to the center of the pile 600.

Of note, the radially extending walls 615-622 are configured to allow passage of bolts and other fastening hardware through the center of each wall 606-609, without compromising (e.g., without piercing or severing) a radially extending wall 615-622. This configuration helps preserve structural integrity, while allowing fastening using conventional means.

The pile 600 includes a plurality of spaces (i.e., volumes) that may fill with material (e.g., soil) as the pile is driven into a seabed or terrain. The spaces include volumes between interior walls, such as volumes 625-632, and central volume 610. If the pile is later removed by pulling upwardly, the volumes 625-632, and central volume 610 tend to remain filled with embedded material if the material is not saturated, because friction forces retain the material in the volumes 610, 625-632.

The bearing capacity for a pile for any given set of soil conditions is the sum of the skin friction and the point bearing. When an axial load is applied to a pile there is an equal and opposite reaction in the earth. A part of this reaction is a tangential force acting on the surface of the pile and called "skin friction." The remainder of the earth reaction is the point resistance or point bearing at the lower end of the pile.

Skin friction is related to coefficient of friction. While the coefficient of friction for wood against soil varies depending upon the types and conditions of the wood and soil, a value that has been previously determined in testing is 0.5. The coefficient of friction for the uncovered surfaces of a pile according to principles of the invention may equal or exceed that of a wood pile in the same soil. The uncovered surfaces include the surfaces of the internal walls that are not covered with a cap stock.

The surface area of the pile 600 that interacts with soil when embedded in a seabed or other terrain is substantially greater than the surface area of a conventional wood pile. The total surface area of the interior structure substantially exceeds the total surface area of the outer surface of the walls 606-609 of the exterior tube 605. The total surface area of the cylinder 612 and radially extending walls 615-622 is about double the surface area of the outer surface of the walls 606-609 of the exterior tube 605. The total surface area of the interior side of the walls 606-609, plus the cylinder 612 and radially extending walls 615-622 is about triple the surface area of the outer surface of the walls 606-609 of the exterior tube 605. The surface area of the exterior walls 606-609 also produces skin friction, albeit less than the skin friction produced by the rougher internal structures.

The pile is comprised of coextruded thermoplastic (e.g., PVC) with glass fibers. The PVC, and pelletized glass fibers and additives are mixed together and extruded as the inner layer. An outer layer, i.e., a cap stock, that enhances impact resistance, provides protection from ultraviolet radiation, and reflects infrared radiation is also provided. The cap stock is relatively smooth. Therefore, the surfaces covered with a cap stock alone do not provide sufficient frictional resistance to descent to mimic a wood pile.

The internal walls of the pile do not contain a cap stock. Portions of reinforcing fibers (e.g., chopped glass fibers) contained in the extruded plastic are palpable. The surfaces of the interior walls feel rough to the touch, because portions of the fibers (e.g., fiber ends) reach the surfaces of the walls.

The surface area of the internal walls equals or exceeds the surface area of the exterior wall of the extruded pile. This arrangement is instrumental in attaining frictional force (i.e., skin friction) that equals or exceeds the friction force between a conventional wood pile and the earth. The friction allows a length of extruded pile comparable to the length of a conventional wood pile to be driven to about the same depth as the wood pile to carry the same or a greater load as the wood pile.

Figure 12:
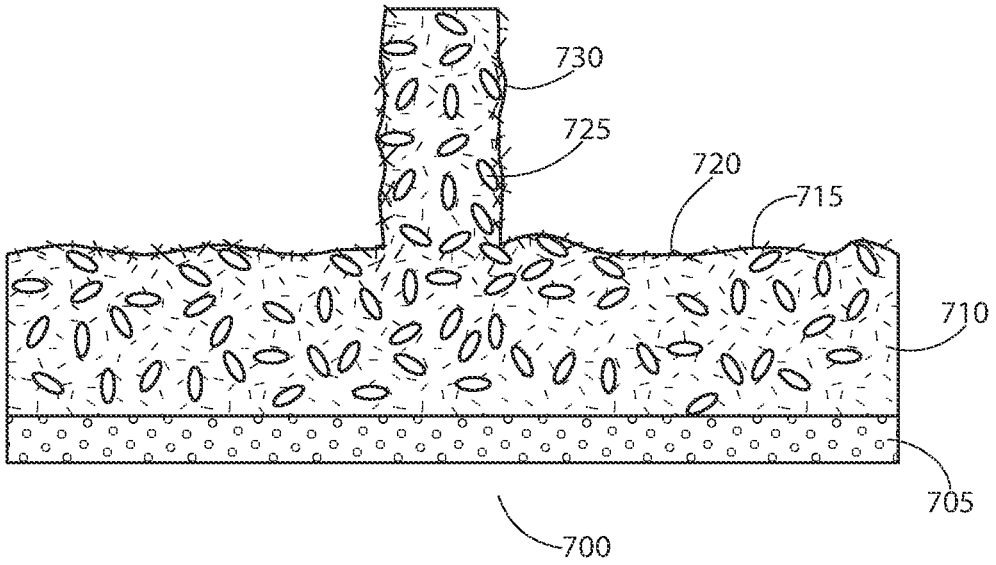
FIG. 12 is a schematic that conceptually illustrates a wall structure for an exemplary pile according to principles of the invention.
Figure 13:
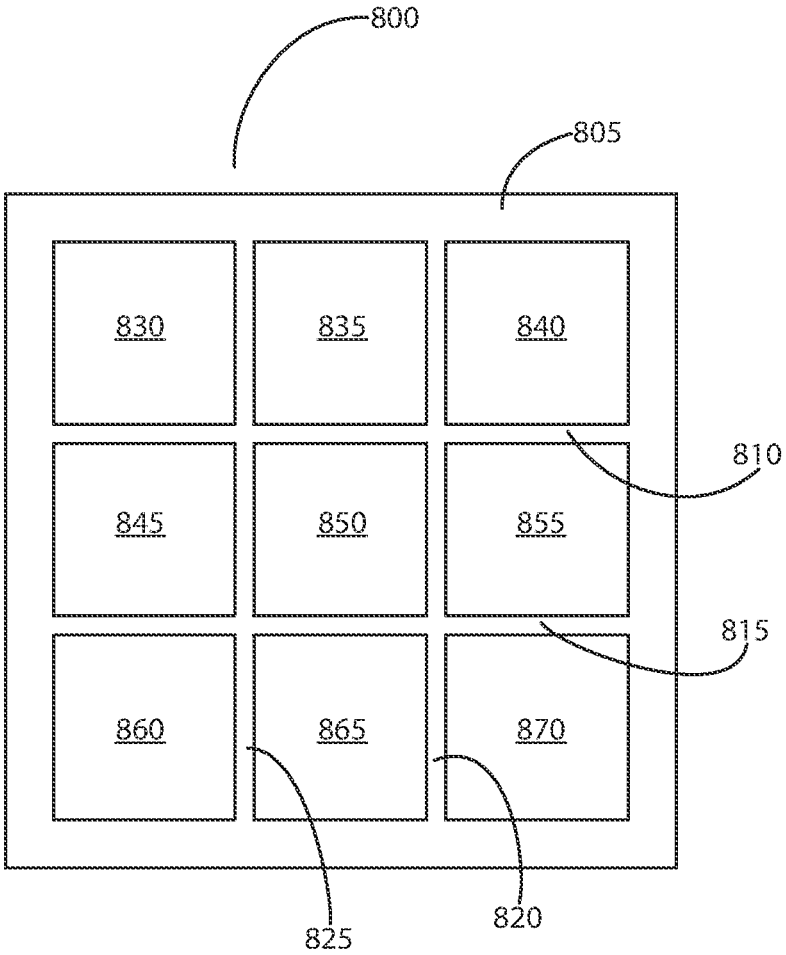
FIG. 13 is a plan view of an exemplary pile with an internal wall structure according to principles of the invention.
Figure 14:
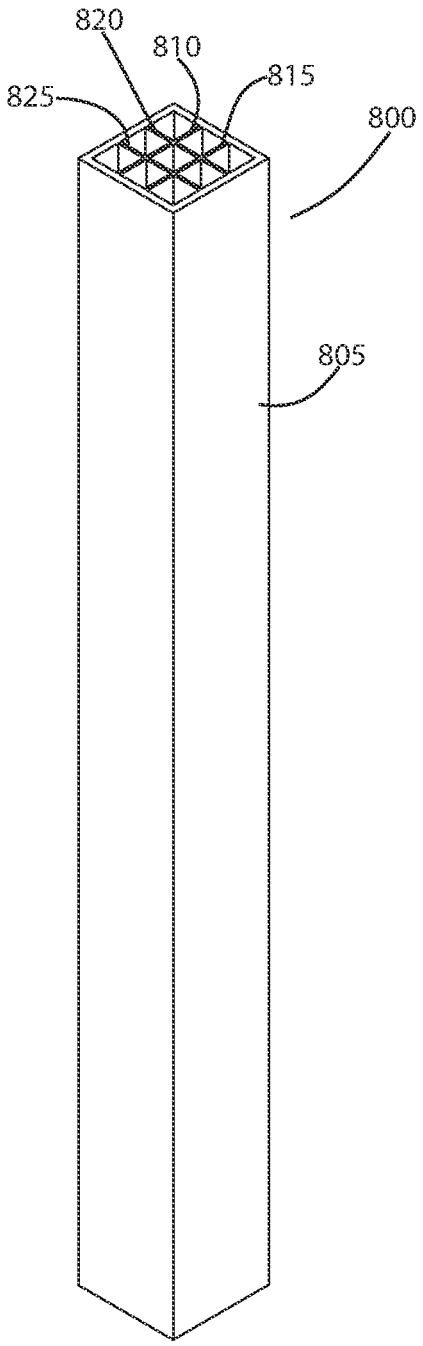
FIG. 14 is a perspective view of an exemplary pile with an internal wall structure according to principles of the invention.

FIG. 12 is a schematic and magnified view that conceptually illustrates a wall structure 700 for an exemplary pile according to principles of the invention. The exterior side of the wall 705 is comprised of a cap stock. The primary wall structure 710 is extruded plastic containing additives, such as polyvinyl chloride (PVC), with chopped strand glass fibers (i.e., short strands of glass fibers). The short strands of glass fibers may be introduced in pellet form. The thermoplastic, pelletized glass fibers and additives are mixed together and extruded. An outer layer, i.e., a cap stock 705, that enhances impact resistance, provides protection from ultraviolet radiation, and reflects infrared radiation is also provided via co-extrusion.

Pelletized clumps of fibers 725 (e.g., clumps about the size of a grain of rice) are included in the mix. Some pelletized glass fibers remain intact in the extrudate. In an exemplary embodiment, 5% to 50% of the pelletized glass fibers remain intact. More preferably, 10% to 45% of the pelletized glass fibers remain intact. The concentration of intact pelletized glass fibers may be controlled by controlling mixing speed and duration, mixer agitator configuration, and concentration of pelletized glass fibers introduced into the mix.

The interior surfaces 715 (i.e., outer surfaces of the interior walls) are bumpy, uneven, not planar smooth. The bumps 730 are visible and palpable. Intact pelletized clumps 725 of fibers (e.g., clumps about the size of a grain of rice) in the extrudate contribute to the bumpiness.

During extrusion, much of the pelletized glass fiber is broken apart into separate strands. Many strands 720 extend to the surfaces of the interior walls. Portions of reinforcing fibers contained in the extruded plastic are palpable at the wall surface 715. The surfaces of the interior walls feel rough to the touch, because portions of the fibers (e.g., fiber ends) 720 reach the surfaces of the walls. Such strands impart a rough, slightly furry, texture to the interior wall surfaces 715.

The bumpiness and roughness provide enhanced friction. The enhanced friction equals or exceeds the skin friction of a comparably sized wood pile. Portions of some chopped glass strands in the extrudate reach the interior surface 715 of the primary wall structure 710. The exposed portions may comprise strand ends, intermediate portions of strands, and entire strands oriented with the interior surface. As the interior surface 715 is not covered with a cap stock, the exposed portions of the chopped glass strands provide a relatively rough surface. This rough surface provides a higher coefficient of friction, than the coefficient of friction of the side covered with a cap stock 705. This roughness results in higher skin friction for the internal surfaces 715 than the exterior walls 705.

Frictional enhancement is provided by the glass fibers. The cap stock is relatively smooth, due to the omission of pellets and glass fibers and sizing of the extrudate. During sizing the extrudate passes through rings or a sleeve designed to ensure a consistent outer diameter or width, within a determined range, without projections or surface irregularities. Therefore, the outer surface does not provide sufficient frictional resistance to mimic a wood pile. However, because some of the pelletized glass fibers remain intact in the extrudate, the interior surfaces (interior walls) are bumpy, uneven, not planar smooth. The interior surfaces are not smoothed in the sizing operation. Pelletized clumps of fibers (e.g., clumps about the size of a grain of rice) in the extrudate contribute to the bumpiness. The bumps are perceptible and palpable. Additionally, during extrusion, much of the pelletized glass fiber is broken apart into separate strands. Many strands extend to the surfaces of the interior walls. Portions of reinforcing fibers contained in the extruded plastic are palpable at the wall surface. The surfaces of the interior walls feel rough to the touch, because portions of the fibers (e.g., fiber ends) reach the surfaces of the walls. Such strands impart a rough, slightly furry, texture to the interior wall surfaces. The bumpiness and roughness provide enhanced friction. The enhanced friction equals or exceeds the skin friction of a comparably sized wood pile. The coefficient of friction of the rough interior surface and rough wall surfaces exceed the coefficient of friction of the cap stock, is at least equal to the coefficient of friction of a wood pile in soil, is at least 0.5. Thus, skin friction caused by the rough interior surface and rough wall surfaces exceeds the skin friction caused by the smooth cap stock. Portions of chopped strand glass fibers extending from the interior surface and wall surfaces. In embodiments with pelletized chopped strand, some intact pellets contribute to bumpiness of the interior surface and wall surfaces. Concomitantly, the surface area of the rough interior surface and rough wall surfaces exceed (e.g., by more than 2 or 3 times) the surface area of the exterior surface of the cap stock. The coefficient of friction and surface area of the rough surfaces contribute to the skin friction caused by the rough surfaces. The exterior surface of the cap stock is smooth because it is substantially free of projections and irregularities because it has passed through sizing equipment.

Optionally, for additional reinforcement, continuous fibers 427 (FIG. 8) or woven or braided strands are pulled through the die in the extrudate, using a pultrusion process. Such an embodiment enhances tensile strength. Lateral forces (e.g., currents, wind, wave action) may produce a bending moment, with a portion of the pile being in tension. Enhanced tensile strength from continuous reinforcements extending through the pile from end to end helps resist deformation from lateral forces and reduces risk of catastrophic failure.

Figure 15:
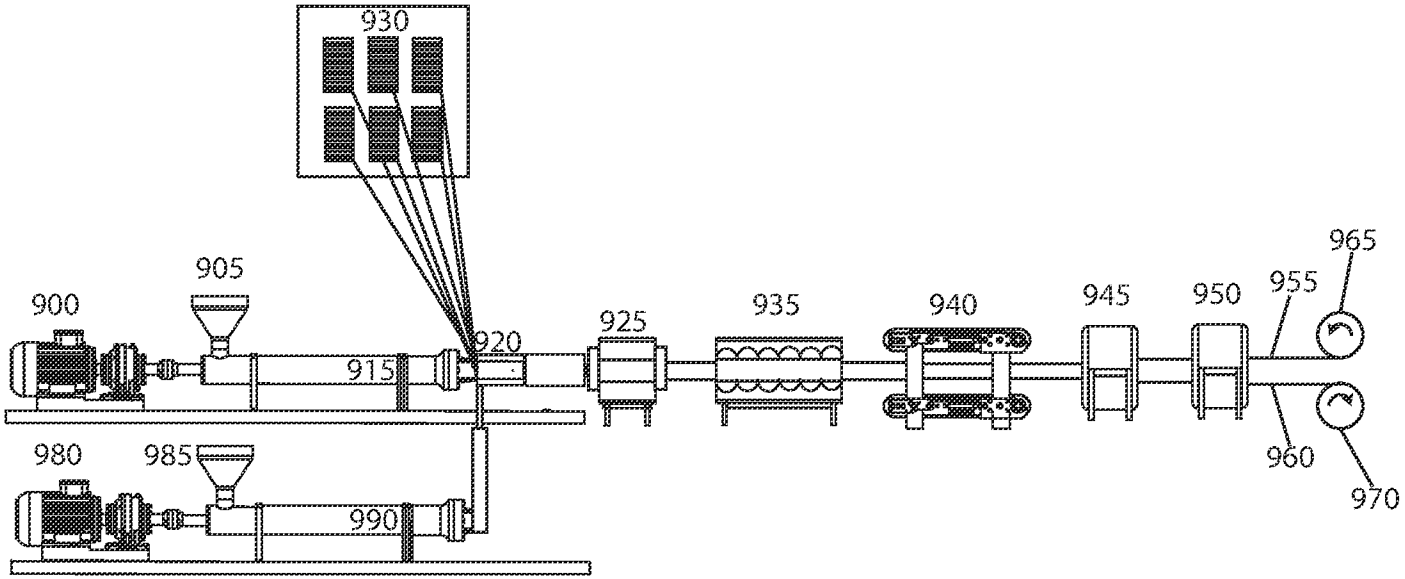
FIG. 15 provides a schematic that conceptually illustrates an extrusion and pultrusion line for producing an exemplary pile according to principles of the invention.

FIG. 15 is a high level schematic of an exemplary system for extruding the pile with pultruded continuous reinforcements. Such a pile may also contain chopped strand reinforcing fibers, such as the pelletized chopped glass fibers discussed above. Raw material comprising a dry blend of polyvinyl chloride powder or pellets and other ingredients, including pelletized glass fibers, are introduced through a hopper 905. cap stock materials are introduced for co-extrusion through another hopper 985. A motor 900 powers one or more screws of an extruder 915. Another motor 980 powers one or more screws of a co-extruder 990. The extruders heat the raw materials supplied through hoppers 905, 980, and forces the resulting melted polymers through an extrusion die 920.

While the figure shows the co-extrusion equipment parallel to the primary extrusion equipment, those skilled in the art will appreciate that the invention is not limited to such an arrangement of extruders. Rather, the extruders may be non-parallel, orthogonally arranged, or arranged at an obtuse or acute angle. Any arrangement suitable for supplying extruded cap stock material to cap stock ports of the die may be used without departing from the scope of the invention.

In one embodiment a plurality of continuous reinforcements (e.g., continuous reinforcements in the form of continuous strands (rovings) or plys (mats, fabrics and veils)) extend axially, beneath the cap stock, e.g., through the pipe (or at the outer surface of the pipe between the pipe and cap stock), coextensive with the pipe. The plurality of continuous reinforcements may be incorporated into the pile via pultrusion. The reinforcement fiber materials are held on creel racks and fed continuously through a guiding system (collimation plates) prior to being drawn through the die 920 in a progressive manner in a configuration consistent with the desired finished profile. On die exit, the hot extrudate containing the fed continuous reinforcements is then sized and cooled.

The dimensions of the extruded pile are determined and set during sizing operations. A sizing operation holds the pile in its proper dimensions during cooling of the material. The process is accomplished by drawing the hot material from the die 920 through a sizing sleeve 925. Sizing may be accomplished by using either vacuum or pressure. By way of example, in a vacuum sizing system, hot extrudate is drawn through a sizing sleeve 925 or rings while its surface is cooled enough to maintain proper dimensions and a circular form. The outside surface of the pile may be held against the sizing sleeve by vacuum or negative pressure.

Optionally, after exiting the vacuum sizing tank 925, or within the vacuum sizing tank 925, the pile moves through one or more cooling sprays or immersion cooling baths 930. The bath may be an integral part of the vacuum sizing tank, or a separate piece of equipment. Various methods of cooling may be utilized to remove residual heat from the pile. The system may use either total immersion or spray cooling, though spray cooling is usually applied to large diameter pile where total immersion would be inconvenient. Cooling water temperatures may be in the range of 40° to 55° F. The cooling tank 935 may contain annealing zones to minimize residual stresses by allowing heat contained within the inner pile wall to radiate outward and anneal the entire pile wall. The total length of the cooling bath should be adequate to cool the pile to a temperature below its glass transition temperature ($T_g$), e.g., below about 175° F. or whatever the $T_g$ is for the particular pile. In an exemplary implementation, the pile is cooled to about 150° F. to 120° F.

As drawn through the cooling tank 935, the pile solidifies from the outside of the wall to the inside of the wall. To cool completely, all the heat energy stored within the wall of the product must be transferred to the water of the cooling tank on the outside of the product. The thinner the wall of the final product, the faster it will cool to the desired temperature. The heavier the wall of the product, the slower it will transfer heat and cool to a uniform solid state. As a poor thermal conductor, the plastic absorbs and relinquishes heat fairly slowly. After spending quite a bit of time being heated in the resin hopper, then heated and sheared in the extruder, and then formed into shape in the heated extrusion die, the product will take some time to give up that stored heat. The thermal conductivity of the resin is a fixed value, heat will only be transferred so fast, no matter how cold the water in the quench tank may be.

Optionally, a puller 940 pulls the pile through the post extrusion operation. The puller may also maintain a proper wall thickness by providing a constant pulling rate. The rate at which the pile is pulled, at least in part, determines the wall thickness of the finished pile. Increasing the puller speed at a constant screw speed may reduce the wall thickness, while reducing the puller speed at the same screw speed may increase wall thickness.

The pile is then cut by a cutter 945 into specified lengths for bundling, storage and shipping. The pile may be cut into any desired lengths (e.g., 8, 10, 12, 16 or more feet). Lengths that are not greater than 40 to 50 feet can be shipped easily by rail or truck. Bundling provides ease of handling and safety during loading and unloading.

The extrusion line may have one or more printing stations 950 for printing notations on the pile. Notations may include characters (e.g., numbers and letters) and graphics (e.g., barcodes and trademarks).

Takeup reels 965, 970 are provided at the end of the line. Initially, the continuous reinforcements (represented at the end of the line by 955, 960, and towards the beginning of the line by 930) are feed through all equipment to the takeup reels. The reels 965, 970 rotate at a speed that takes up the continuous fiber at the same speed as the speed at which the extruded pile advances through the extrusion equipment. As the pile is extruded and cut, the continuous fibers extending to the reels 965, 970 are severed, and the reels 965, 970 may cease operation fro the remainder of the extruding session. The continuous fibers are embedded in the extruded pile. After the fibers extending to the reels 965, 970 are severed, advancement of the extruded pile through the line continues to draw (pull) the embedded continuous fibers through the line.

Optionally, the co-extruded cap stock may contain pigments, dyes and/or other colorants. By way of example, the co-extruded cap stock may contain a thermoplastic acrylic with pigments, dyes and/or other colorants to achieve a desired visual appearance. Such pigments, dyes and/or other colorants may include retroreflective elements such as microspheres embedded in a binder layer (i.e., the acrylic) with associated specular or diffuse reflecting materials (e.g., pigment particles, metal flakes or vapor coats, etc.) to retroreflect incident light. Thus, the cap stock of piles according to principles of the invention may be colored red or green, and exhibit retroreflective properties, allowing the piles to serve as nautical beacons.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. An integrally formed extruded pile comprising:

a pipe having an outer surface, an interior surface, an outer width, measured from a first point on the outer surface to an opposite point on the outer surface, of at least four inches, and a length from a first end to an opposite second end; and a plurality of intersecting walls within the pipe, the intersecting walls being coextensive with the pipe and having wall surfaces, the intersecting walls intersecting the pipe at the interior surface; and the extruded pile being comprised of a blend of a thermoplastic and chopped strand glass fibers, the chopped strand glass fibers in the extruded pile including intact pellets of pelletized chopped strand glass fibers and distinct strands of chopped strand glass fibers; and a co-extruded cap stock covering the outer surface of the pipe, and the cap stock not containing chopped strand glass fibers, the co-extruded cap stock having an exterior surface; and the coefficient of friction of the interior surface and wall surfaces being greater than the coefficient of friction of the exterior surface of the cap stock in soil.

2. The integrally formed extruded pile according to claim 1, the interior surface and wall surfaces providing resistance to uplift.

3. The integrally formed extruded pile according to claim 1, further comprising a plurality of continuous reinforcements extending axially beneath the cap stock, coextensive with the pipe, the plurality of continuous reinforcements being incorporated into the pile via pultrusion.

4. The integrally formed extruded pile according to claim 1, wherein the pipe, excluding the cap stock, and the intersecting walls comprise a blend of a thermoplastic and 20 to 50% (pbw) chopped strand glass fibers.

5. The integrally formed extruded pile according to claim 4, portions of the chopped strand glass fibers extending from the interior surface and wall surfaces.

6. The integrally formed extruded pile according to claim 4, the outer surface having a first surface area; and the plurality of intersecting walls having a second surface area; and the second surface area being greater than the first surface area.

7. The integrally formed extruded pile according to claim 6, the interior surface of the pipe having a third surface area, the sum of the second surface area and the third surface area being at least twice the first surface area.

8. The integrally formed extruded pile according to claim 6, the interior surface of the pipe having a third surface area, the sum of the second surface area and the third surface area being at least thrice the first surface area.

9. The integrally formed extruded pile according to claim 4, the coefficient of friction of the interior surface and wall surfaces exceeding 0.5.

10. The integrally formed extruded pile according to claim 4, the coefficient of friction of the interior surface and wall surfaces being at least 0.5.

11. The integrally formed extruded pile according to claim 4, the pipe having one of an annular cross-section shape and a hollow rectangular cross-section shape.

12. The integrally formed extruded pile according to claim 4, a groove formed in the exterior surface adjacent to the first end, the groove providing a rough surface that resists uplift.

13. The integrally formed extruded pile of claim 12, the groove comprising a continuous spiral groove extending from the first end to a position along the length, the position being between a midpoint of the length and the first end.

14. The integrally formed extruded pile of claim 12, the groove comprising a series of spaced apart parallel grooves extending from the first end to a position along the length, the position being between a midpoint of the length and the first end.

15. The integrally formed extruded pile of claim 4, the cap stock comprising an infrared radiation inhibitor.

16. The integrally formed extruded pile of claim 15, the cap stock further comprising an impact modifier.

17. The integrally formed extruded pile of claim 16, the cap stock further comprising a colorant.

18. The integrally formed extruded pile of claim 4, the pipe having a wall thickness of 0.25 to 0.50 inches, and each wall of the plurality of intersecting walls having a wall thickness of 0.125 to 0.5 inches.

19. The integrally formed extruded pile according to claim 1, wherein at least portions of some of the intact pellets and at least portions of some of the distinct strands of the chopped strand glass fibers are palpable at the interior surface and wall surfaces.

20. The integrally formed extruded pile according to claim 1, wherein none of the intact pellets and none of the distinct strands is palpable at the exterior surface of the cap stock.

* * * * *